US005174918A

United States Patent [19]

Diehl et al.

[11] Patent Number: 5,174,918

[45] Date of Patent: Dec. 29, 1992

[54] STABLE AQUEOUS SUSPENSIONS OF DETERGENT ZEOLITES AND FOUR OXO-ALCOHOL ETHOXYLATES

[75] Inventors: Manfred Diehl, Frankfurt am Main; Roland Bergmann, Grosskrotzenburg, both of Fed. Rep. of Germany

[73] Assignee: DEGUSSA AG, Hanau, Fed. Rep. of Germany

[21] Appl. No.: 506,993

[22] Filed: Apr. 10, 1990

Related U.S. Application Data

[63] Continuation of Ser. No. 371,674, Jun. 23, 1989, abandoned, which is a continuation of Ser. No. 200,849, Jun. 1, 1988, abandoned.

[30] Foreign Application Priority Data

Jun. 6, 1987 [DE] Fed. Rep. of Germany ..... 3719042

[51] Int. Cl.[5] ..... C11D 1/68; C11D 9/18; C11D 3/02

[52] U.S. Cl. ..... 252/174.22; 252/179; 252/174.25

[58] Field of Search ..... 252/174.21, 174.22, 252/174.25, 179

[56] References Cited

U.S. PATENT DOCUMENTS

| | | | |
|---|---|---|---|
| 4,083,793 | 4/1978 | Jakobi | 252/99 |
| 4,405,483 | 9/1983 | Kuzel | 252/140 |
| 4,438,012 | 3/1984 | Kühling | 252/131 |
| 4,486,331 | 12/1984 | Diehl | 252/174.25 |

FOREIGN PATENT DOCUMENTS

| | | |
|---|---|---|
| 0000870 | 7/1978 | European Pat. Off. . |
| 2527388 | 4/1976 | Fed. Rep. of Germany . |
| 3504450 | 8/1986 | Fed. Rep. of Germany . |
| 2500474 | 8/1982 | France . |

OTHER PUBLICATIONS

Tenside, 466, pp. 57-62, Fahn et al. (1985).

*Primary Examiner*—A. Lionel Clingman
*Assistant Examiner*—E. Higgins
*Attorney, Agent, or Firm*—Beveridge, DeGrandi & Weilacher

[57] ABSTRACT

A stable, pumpable, aqueous solution of a water-insoluble silicate capable of binding calcium ion is shown which, referred to the total weight of the aqueous suspension, contains A) 0.5 to 80% by weight of a finely divided, synthetic water-insoluble compound containing bound water and in the form of a silicate capable of binding calcium and of the formula:

$$(Cat_{2/n}O)_x \cdot Me_2O_3(SiO_2)_y$$

where Cat is an n-valent cation exchangeable with calcium, x is number from 0.7 to 1.5, Me is boron or aluminum and y is number from 0.8 to 6, and B) 0.5 to 6% by weight of a mixture acting as the dispersing ingredient and formed of at least two oxo-alcohol ethoxylates of formula:

$$R-(OCH_2CH_2)_n-OH$$

where R—$C_{10}$—$C_{15}$ alkyl with a maximum branching rate of 25%, that is, at most 25% of the fatty alcohol ethoxylate comprises single methyl branching, n=3-5.0 moles of ethylene oxide for component 1, n=5.5-7 moles of ethylene oxide for component 2.

The suspension can be used in manufacturing powdered detergents and cleaning agents.

27 Claims, No Drawings

STABLE AQUEOUS SUSPENSIONS OF DETERGENT ZEOLITES AND FOUR OXO-ALCOHOL ETHOXYLATES

This application is a continuation of application Ser. No. 07/371,674 filed Jun. 23, 1989 now abandoned, which is a continuation of 07/200,849, filed Jun. 1, 1988 now abandoned.

INTRODUCTION AND BACKGROUND

Methods for washing and cleaning solid materials, in particular textiles, are widely known in the art. Moreover, suitable detergents and cleaning agents to carry out such methods are know wherein the function of the phosphates in binding calcium in complexes is taken over wholly or in part by finely divided, water-insoluble aluminum silicates capable of binding calcium (German OLS 24 12 837).

These are compounds of the general formula:

$$(Cat_{2/n}O)_x \cdot Me_2O_3 \cdot (SiO_2) \quad (I)$$

where Cat is an n-valent cation exchangeable with calcium, x is a number from 0.7 to 1.5, Me is aluminum and y is a number from 0.8 to 6, preferably from 1.3 to 4.

The preferred cation is sodium, though it may also be replaced by lithium, potassium, ammonium or magnesium.

The above defined compounds capable of binding calcium hereafter are termed "aluminum silicates" for the sake of simplicity. This applies especially to the preferred sodium aluminum silicates; all statements made relative to the latter concerning their use according to the invention, further all statements relative to their properties, apply corresponding to all of the above defined compounds.

The aluminum silicates that are especially well suited for use in detergents and cleaning agents are those that have a calcium binding capability of 50 to 200 mg CaO/g of the anhydrous aluminum silicate. As used herein the term "anhydrous aluminum silicate" is intended to mean that state of the aluminum silicate which is reached after drying at 800oC for 1 hour. During this drying, the surface water and bound water is virtually entirely removed.

When manufacturing detergents and cleaning agents containing in addition to their conventional components also the above defined aluminum silicates, it is preferable that the initial aluminum silicates should be moist, as for instance on account of the method of preparation thereof. In the process, the moist compounds are mixed with at least part of the remaining components of the detergent or cleaning agent to be produced. By means of conventional steps such as spray drying, the mixture is converted into the final detergent or cleaning agent, as for instance a free-flowing product.

Within the scope of the above outlined preparation of detergents and cleaning agents, the aluminum silicates are supplied, for example in the form of aqueous suspensions. In this regard it would be desirable if further improvements in the properties of the suspension could be achieved, for instance stability and pumpability of the aluminum silicates dispersed in the aqueous phase.

It is known to employ alkylphenolethylene adducts in the formation of suspensions of aluminum silicates. Illustratively, adducts with 6 to 7 moles of ethylene oxide are used (German OSL 26 15 698).

Increasing emphasis is placed on biological degradability of detergents on account of ecology and the environment. In addition to the primary degradation; i.e. the loss of surfactant properties, the secondary degradability, namely mineralization, is assuming increasing significance.

Both the primary and the secondary biodegradability depend on the linearity of the carbon chain, in other words, the biodegradability as a rule will be the poorer with increased branching of the carbon chain.

Because of their benzene ring and their branched nonyl residue, the nonylphenol ethoxylates used in the German OLS 32 09 631 are poorly biodegradable, there being a special danger that a metastable decomposition product be formed in the form of toxic nonylphenol. This is the reason that the German detergent industry has renounced using nonylphenol ethoxylates. Switzerland is expected to ban its use also.

The iso-tridecyl alcohol ethoxylates employed in the German OLS 34 44 311 concerns, as indicated by the name, branched-chain oxo-alcohols with a branching rate of at least 50%. Furthermore these are isomeric mixtures of undeterminable structure, frequently with all kinds of possible branchings such as methyl, ethyl, propyl, iso-propyl and others.

Accordingly a prejudice existed in the art that preferably only such branched surfactants were suitable for the zeolite A slurry stabilization.

SUMMARY OF INVENTION

Now is has been determined that certain mixtures of substantially linear oxo-alcohol ethoxylates are especially capable to stabilize suspensions of the above calcium-binding aluminum silicates in such a manner that these silicates, even at high solid contents, remain stable over a long period of time and even after long standing can be pumped in problem-free manner. Surprisingly it was found that these specific mixtures are capable to maintain even moist aluminum silicates with a water content of 70% or less in a stable condition against sedimentation without the need of stirring.

An object of the present invention is to provide an aqueous, stable, pumpable suspension of water-insoluble silicate capable of binding calcium ions, this silicate being characterized in that, relative to the total weight of the aqueous suspension, it comprises A) as a calcium-binding silicate, from 0.5 to 80% by weight of a finely divided, synthetically prepared water-insoluble compound containing bound water and represented by the general formula $$(Cat_{2/n}O)_x \cdot Me_2O_3 \cdot (SiO_2)y \quad (I)$$

where Cat is an n-valent calcium-exchangeable cation, x is a number from 0.7 to 1.5, Me is boron or aluminum and y is a number from 0.8 to 6, and B) as a dispersant from 0.5 to 6% by weight, preferably 1 to 2, especially 1.4 to 1.6% by weight of a mixture of at least two oxo-alcohol ethoxylates of formula II $$R—(OCH_2CH_2)_n—OH$$

where $R = C_{10}$-$C_{15}$ alkyl with a maximum branching rate of 25%, that is, at most 25% of the fatty alcohol ethoxylate has a simple methyl branching, and where n = 3–5.0 moles of ethoxylate in component I n = 5.75–7 moles of ethylene oxide in component II In the suspension of the invention, component A preferably can be crystalline.

In formula I of component A, y can be a number from 1.3 to 4.

In a preferred implementation, the crystalline component A is an A-type zeolite.

The above compounds are the essential ingredients of the suspension of the invention. However further constituents may be present as will be apparent to those skilled in the art. For instance, froth-inhibiting additives; i.e. so-called solubilizers which are compounds for improving the solubility of the added dispersants in the aqueous phase can be used. Suitable froth inhibitors are the conventional froth-inhibiting substances such as silicone defoamers, antifroth triazine derivatives, which all are know in the art and in common use. As a rule they need not be used, though where the dispersants foam, in particular when using higher quantities of alkylbenzene sulfonic acid, they may be called for.

In general, the addition of solubilizers will not be required, though it may be called for if the suspension of the invention contains a hydrophilic colloid which nevertheless is only slightly water soluble as the stabilizer, for instance polyvinyl alcohol. Advantageously such highly suitable solubilizers as sodium toluene sulfonate or polyglycolether are used.

The proportion of solubilizer in the total suspension for instance may be about the same as that of the stabilizer. The person skilled in the art will know if further compounds that are suitable as solubilizers: Hydrotopic substances such as benzene sulfonic acid, xylene sulfonic acid or their water-soluble salts are suitable, as well as octyl sulfate.

All statements concerning the "aluminum silicate concentration", the "solid content" of the "active substance content" refer to the condition of the aluminum silicate reached after drying 1 h at 800° C. By means of this drying, the adhering water as well as the bound water is virtually removed in its entirety.

The aluminum silicates of component A may be amorphous or crystalline, and it is to be noted that mixtures of amorphous and crystalline and partly crystalline products also may be employed. The aluminum silicates may be natural or synthetic, the latter being preferred. They may be prepared by methods known in the art, as for instance, by reacting water-soluble silicates with water-soluble aluminates in the presence of water. For that purpose, aqueous solutions of the initial substances can be mixed, or one solid component may be reacted with the other present as an aqueous solution. Two solid components when mixed in the presence of water will result in the desired aluminum silicates. Aluminum silicates may be prepared by reacting $Al(OH)_2$, $Al_2O_3$ or $SiO_2$ with solutions of alkali silicate or alkali aluminate. The preparation also may use other known procedures. In particular the invention concerns aluminum silicates with three-dimensional space lattices.

The preferred calcium-binding capacity in the range of about 100 to 200 mg of CaO/g of aluminum silicate (AS) and mostly within about 100 and 180 mg CaO/g of aluminum silicate (AS) is present mostly in compounds with the following composition $$0.7\text{–}1.1\ Na_2O.Al_2O_3.\ 1.3\text{–}3.3\ SiO_2$$

This formula covers two types of different crystal structures (or their non-crystalline antecedents) which are distinguishable by their formulas. These are:

a) $0.7\text{–}1.1\ Na_2O.Al_2O_3.\ 1.3\text{–}2.4\ SiO_2$ b) $0.7\text{–}1.1\ Na_2O.Al_2O_3.\ 2.4\text{–}3.3\ SiO_2$.

The different crystal structures show up in x-ray diffraction.

The amorphous or crystalline aluminum silicate present in aqueous suspension can be separated by filtration from the remaining aqueous solution and can be dried at temperatures, illustratively between 50° and 400° C. Depending on the drying, the product contains more or less bound water.

As a rule such high drying temperatures should not be used; generally 200° C. should not be exceeded where the aluminum silicate is intended for detergents and cleaning agents. In fact, following their preparation, the aluminum silicates need not be dried at all when making a suspension of the invention; instead, and in a particularly advantageous manner, aluminum silicate can be used that is still moist from its preparation. Nevertheless, aluminum silicates that have been dried at medium temperatures, for instance at 80° to 200° C., until the adhering water has been removed, may be used in making the suspensions of the invention.

The individual aluminum silicate particles may vary in size and for instance in the range between 0.1$\mu$ and 0.1 mm. It is especially advantageous to employ aluminum silicates which consist at least by 80% by weight of particles having sizes from 10 to 0.01$\mu$ and preferably from 8 to 0.1 $\mu$.

Preferably the aluminum silicates do not contain primary or secondary particles with diameters in excess of 45$\mu$. Secondary particles are those produced by aggregated primary particles to form larger structures.

As regards the aggregation of primary particles into larger structures, the use of moist aluminum silicates has been found especially valuable in preparing the suspensions of the invention because it was found that such moist products essentially completely suppress any agglomeration.

In an especially preferred embodiment of the invention, the component A is a type A powder zeolite with any especially well defined particle size distribution.

Such zeolite powders can be prepared in the manner disclosed in the German ALS 24 47 021; 25 17 218; in the German OLS 26 52 419; 26 51 420; 26 51 436; 26 51 437; 26 51 445, and 26 51 485. The resulting powders obtained exhibit the particle distribution curves found therein.

In an especially embodiment, a type A powder zeolite may be used which exhibits the particle size distribution described in the German OLS 26 51 485. The prior art describing these zeolites and manner of preparation is relied on and incorporated by reference.

Preferably the concentration of component A is 44 to 55% by weight, especially 46 to 52% by weight.

The component B can advantageously be formed of a mixture of two oxo-alcohol ethoxylates, where the one ethoxylate component is an oxo-alcohol ethoxylate with 3–5.0 moles of ethylene oxide and a turbidity point of 56°–69° C., preferably with 4–5 moles of ethylene oxide and turbidity point of 62°–67° C., the carbon chain R having 10–15, preferably 12–13 C atoms. The second ethoxylate component is an oxo-alcohol ethoxylate with 5.5–7 moles of ethylene oxide and a turbidity point of 70°–80° C., preferably 5.5–6.5 moles of ethylene oxide and a turbidity point of 71°-79° C., carbon chain R having 10-15, preferably 12-15 C atoms.

The oxo-alcohol ethoxylates may be mixed in a ratio of 9:1 to 1:9 preferably 2:3 to 3:2, especially 0.9:1.1 to 1.1:0.9.

The concentration of this mixture in the aqueous suspension preferably is 1-2% by weight, especially 1.4-1.6% by weight. This concentration is sufficient to stabilize a suspension with a solids content of 50% and more.

The suspension of the invention offers the advantage of being stable with respect to sedimentation and of exhibiting pumpable consistency in the temperature range from 10° to 50° C.

Advantageously, the oxo-alcohol ethoxylate is liquid at room temperature and therefore needs no heating.

Especially advantageous, solid contents significantly higher than 50% can be achieved in the suspension of the invention.

The known suspension of the German OLS 26 15 698 exhibits lesser sedimentation stability and for the same admixing conditions at room temperature will not be homogeneous and therefore its processing will be poorer.

In addition to the described ingredients A and B and aqueous solutions may in principle also contain comparatively small amounts of additional substances. If there is to be further processing of the suspension into detergents and cleaning agents, then such additionally present substances obviously are appropriate as components of detergents and cleaning agents. Such conventional components are known in the art.

A simple test allows ascertaining the stability of the suspension, whereby an aluminum silicate suspension of the desired concentration, for instance at 31%, is prepared, which contains a dispersant of the invention and possibly further substances, for instance such detergent ingredients as pentasodium triphosphate, in various amounts. The effect of the added substance then can be visually observed by the settling behavior of the suspension. After standing for 72 h, their settling of a preferred solution at most will be such that the supernatant clear solution, and which is free of silicate particles, is no more than 20%, preferably no more than 10%, especially no more than 6% of the total height.

As a rule the amount of additives can be such that after 24 h, preferably 48 and especially 72 hours of standing in the reservoir and pipes or hoses, the suspension can be pumped without difficulty. The settling behavior of the suspension, which may contain further ingredients, is checked at room temperature. It remains properly pumpable even after 4 and 8 days. Again, such suspension stability data are merely guidelines; the particular case shall determine which suspension stability to adjust for. When using the suspension of the invention as the parent suspension for substantial storage in a reservoir from which it may be pumped out as needed, it may be appropriate to reduce or even entirely eliminate the proportion of other ingredients, for instance detergents or cleaning agents.

The suspensions can be prepared by merely mixing their ingredients, the aluminum silicates for instance being added as such or, possibly in the form directly obtained from their preparation, still moist, in an aqueous suspension. Especially advantageously the component B can be stirred into the aluminum silicates in the form of filter cakes and still moist from their production.

Aluminum silicates can be used which previously have been dried, that is which have been freed of adhering, or possibly bound water.

The suspensions of the invention are characterized by their high stability and by further advantages. Their stabilizing effect is especially valuable where the aluminum silicates have particle sizes from 5 to 30μ. They can be pumped and therefore make possible easy handling of the moist silicates. Even following long stoppages in pumping, the suspensions can be freely pumped again. Because of their high stabilities, the suspensions can be shipped in ordinary tanker vehicles without the danger of forming bothersome or unusable residues. As a result, the suspensions are extremely well suited to deliver aluminum silicates for instance to producers of detergents.

The suspensions can be stored at room and also higher temperatures; they may be pumped through pipes or moved in other ways. Most of the time the suspensions are handled at temperatures between the typically preferred ambient and 50° C.

The suspensions of the invention lend themselves especially well to further processing into apparently dry, friable or free-flowing products allowing pouring, that is, illustratively to make powdered aluminum silicates. When the aqueous suspensions are being moved to the drying equipment, no bothersome residues are left behind. It was shown also that the suspensions of the invention allow processing into products extremely free of dust.

Because of their special stability, the suspensions of the invention can be used without being processed further, and can be used with or without other washing, bleaching, and/or cleaning additives, as water softeners, detergents or cleaning agents, and especially as liquid, mild scouring agents with increased suspension stability.

A particularly important application of the suspension is the further processing into apparently dry, friable or free-flowing detergents and cleaning agents allowing pouring and which contain, aside from the suspension forming ingredients, further compounds.

The suspensions of the invention are especially well suited to make powdered detergents and cleaning agents.

These agents and detergents are prepared from an aqueous, flowable pre-mixture of the individual ingredients of said agents and detergents, and this mixture then is converted into a friable or free-flowing product. The above defined aluminum silicates are employed in this procedure in the form of the suspension of the invention. The suspensions of the invention can be processed by customary known methods into the solid, friable detergents and cleaning agents.

In particular the preparation of pulverulent, friable detergents and cleaning agents is carried out in such a manner that a suspension of the invention coming illustratively from a reservoir or container is mixed with at least one washing, bleaching or cleaning ingredient of the detergent or agent to be prepared, and in that the mixture thereupon is converted by any customary method into the powdered product. Advantageously a complexing agent is added, that is, a compound capable of binding into a complex the earth alkali metal ions, in particular magnesium and calcium ions, which cause water hardness.

In general, the suspension of the invention is advantageously combined in the manufacture of detergents and cleaning agents with at least one water-soluble surfactant which is not part of the applicable ingredients of the component B.

DETAILED DESCRIPTION OF INVENTION

The preparation of detergents and cleaning agents can be carried out in a number of variations.

Illustratively the suspensions of the invention can be combined with substances capable of binding the water of crystallization, appropriately by spraying the suspension onto said compounds previously placed in a mixer, in order to bind these compounds capable of binding the water of crystallization, whereby upon thorough mixing a solid product of dry appearance will be eventually obtained. Preferably, the suspensions of the invention however are mixed to form slurries and then subjected to spray drying together with at least another detergent or bleaching compound. In this case the claimed aluminum silicate suspension displays further and surprising advantages. It have been found that when using suspensions of the invention in spray drying, very dust-free products can be produced. The products made by spray drying exhibit very high calcium binding and are easily wettable.

Detergents made using the above suspension can assume the most diverse compositions. As a rule they contain at least one water-soluble surfactant other than those dispersants claimed in the invention and present in the claimed aluminum silicate solutions. Generally they contain a calcium-binding compound such as the above defined aluminum silicate in addition to at least another compound acting as a detergent or a bleaching or cleaning agent. Moreover such agents or detergents may include other conventional accessories and additives in small amounts.

The following examples serve to further illustrate the present invention:

There is mixed together a zeolite A filter cake and stabilizer, and, where called for with addition of water.

Compounds described by formula II are used as the stabilizer. The degree of ethoxylation EO is stated. The zeolite A filter cake used in the process is prepared according to the German OLS 26 51 485 and exhibits the particle size range stated therein.

To carry out the example, 50 kg of unstabilized zeolite suspension are mixed with an Ekato standard mixer agitator having a paddle. The mixing taking place for 1 hour at 500 rpm, with addition of water where needed.

Following addition of 1.5% by weight of the stabilizer mixture, mixing at the same speed continues for 10 minutes.

Analysis as shown in Table 1 takes place after 3 days.

Table 1 describes the turbidity points of the stabilizers used.

Table II through VIII, the oxo-alcohols with the carbon chains $C_{12}/C_{13}$ are denoted as oxo-alcohols 23.

Correspondingly, an oxo-alcohol with $C_{14}/C_{15}$ is denoted as oxo-alcohol 45 and an oxo-alcohol with $C_{12}$ to $C_{15}$ as oxo-alcohol 25.

Oxo-alcohol 23–4.515.5 denotes a 1/1 mixture of the oxo-alcohol $C_{12}/C_{13}$ with 4.5 moles of ethylene oxide with an oxo-alcohol $C_{12}/C_{13}$ with 5.5 moles of ethylene oxide.

In all Examples the zeolite A concentration is 50%.

TABLE 1

Turbidity points per DIN 53 917 of the various alcohol ethoxylates (5 g of Surfactant in 25% butyldiglycol solution)

| | | |
|---|---|---|
| $C_{13}$ Oxoalcohol - | 4.5 EO | 66° C. |
| " | 5.0 EO | 69° C. |
| " | 5.5 EO | 69° C. |
| " | 6.0 EO | 72° C. |
| " | 6.5 EO | 76° C. |
| " | 7.0 EO | 79° C. |
| $C_{12/13}$ Oxalcohol - | 4.0 EO | 62° C. |
| " | 4.5 EO | 65° C. |
| " | 4.75 EO | 66° C. |
| " | 5.0 EO | 68° C. |
| " | 5.5 EO | 71° C. |
| " | 6.0 EO | 74° C. |
| " | 6.5 EO | 76° C. |
| " | 7.0 EO | 78° C. |
| $C_{14/15}$ Oxoalcohol | 5 EO | 65° C. |
| " | 7 EO | 79° C. |
| " | 11 EO | 86° C. |
| $C_{12-15}$ Oxoalcohol | 5 EO | 60° C. |

Examples 9–33 show that slightly branched tridecyl alcohol ethoxylates corresponding by their rate of branching to the oxo-alcohol ethoxylates of the invention are unsuited for slurry stabilization.

Accordingly it was surprising that a combination of precisely these slightly branched products, namely those employed in the invention, can stabilize a zeolite A slurry extremely effectively.

The oxo-alcohol ethoxylates used in the invention are 80% linear and as regards the residual 20% merely exhibit methyl branching. Therefore they are easily biodegradable.

Further variations and modifications of the foregoing will be apparent to those skilled in the art and are intended to be encompassed by the amended claims.

German priority application P 37 19 042.3-93 is relied on and incorporated herein by reference.

TABLE II

STABILIZATION OF WESSALITH S. WITH OXO-ALCOHOL ETHOXYLATES

| | 1 | 2 | 3 | 4 | 5 |
|---|---|---|---|---|---|
| | Oxoalcohol 23–4.5/5.5 | Oxoalcohol 23–4.5/6.0 | Oxoalcohol 23–4.75/6.0 | Oxoalcohol 23–4/6.5 | Oxoalcohol 23–5/45–7 |
| Standing Time (days) | 3/3 | 3/3 | 3/3 | 3/3 | 3/3 |
| Temperature (°C.) | 22/45 | 22/45 | 22/45 | 22/45 | 22/45 |
| Clear Phase (mm) | —/2 | —/— | —/1 | —/— | 1/1 |
| Homogeneity | 1/2 | 1/1 | 1/2 | 1/1 | 1/1 |
| Flowability | 1/2 | 1/1 | 1/2 | 1/1 | 1/1 |
| Bottom Sediment (mm) | —/— | —/— | —/— | —/— | —/— |
| Remark | — | — | — | Viscous | — |

Homogeneity and flowability are rated on scale of 1 to 5. 1 very good. 5 defective.

TABLE III

STABILIZATION OF WESSALITH S. WITH OXO-ALCOHOL ETHOXYLATES

| | 6 Oxoalcohol 25-5.45-7 | 7 Oxoalcohol 45-5/45-7 | 8 Oxoalcohol 25-5/23-6.5 | 9 Oxoalcohol 23-5.0 | 10 Oxoalcohol 23-5.5 |
|---|---|---|---|---|---|
| Standing Time (days) | 3/3 | 3/3 | 3/3 | 3/3 | 3/3 |
| Temperature (°C.) | 22/45 | 22/45 | 22/45 | 22/45 | 22/45 |
| Clear Phase (mm) | 1/5 | 1/5 | 1/2 | —/— | —/— |
| Homogeneity | 1/5 | 2/5 | 1/5 | 2/2 | 2/2 |
| Flowability | 1/5 | 1/5 | 1/5 | 4/4 | 4/4 |
| Bottom Sediment (mm) | —/— | —/— | —/— | —/— | —/— |
| Remark | — | — | — | Viscous | — |

Homogeneity and flowability are rated on scale of 1 to 5, 1 very good, 5 defective.

TABLE IV

STABILIZATION OF WESSALITH S. WITH OXO-ALCOHOL ETHOXYLATES

| | 11 Oxoalcohol 23-6.0 | 12 Oxoalcohol 23-6.5 | 13 Oxoalcohol 23-7.0 | 14 Oxoalcohol 23-5.5/6.0 | 15 Oxoalcohol 23-5.5/7.0 |
|---|---|---|---|---|---|
| Standing Time (days) | 3/3 | 3/3 | 3/3 | 3/3 | 3/3 |
| Temperature (°C.) | 22/45 | 22/45 | 22/45 | 22/45 | 22/45 |
| Clear Phase (mm) | —/— | —/— | —/— | —/— | —/— |
| Homogeneity | 2/2 | 2/2 | 2/2 | 3/2 | 3/2 |
| Flowability | 4/4 | 4/4 | 4/4 | 4/4 | 4/4 |
| Bottom Sediment (mm) | —/— | —/— | —/— | —/— | —/— |
| Remark | Viscous | Viscous | Viscous | Viscous | Viscous |

Homogeneity and flowability are rated on scale of 1 to 5, 1 very good, 5 defective.

TABLE V

STABILIZATION OF WESSALITH S. WITH OXO-ALCOHOL ETHOXYLATES

| | 16 Oxoalcohol 23-6.0/6.5 | 17 Oxoalcohol 23-5.0/7.0 | 18 Oxoalcohol 23-4.5/7 | 19 Oxoalcohol $C_{13}$-4.5 | 20 Oxoalcohol $C_{13}$-5.0 |
|---|---|---|---|---|---|
| Standing Time (days) | 3/3 | 3/3 | 3/3 | 3/3 | 3/3 |
| Temperature (°C.) | 22/45 | 22/45 | 22/45 | 22/45 | 22/45 |
| Clear Phase (mm) | —/— | —/— | —/— | —/— | —/— |
| Homogeneity | 2/2 | 3/3 | 2/1 | 2/2 | 2/2 |
| Flowability | 4/4 | 4/4 | 5/1 | 4/4 | 4/4 |
| Bottom Sediment (mm) | —/— | —/— | —/— | —/— | —/— |
| Remark | Viscous | Viscous | — | Viscous | Viscous |

Homogeneity and flowability are rated on scale of 1 to 5, 1 very good, 5 defective.

TABLE VI

STABILIZATION OF WESSALITH S. WITH OXO-ALCOHOL ETHOXYLATES

| | 21 Oxoalcohol $C_{13}$-5.5 | 22 Oxoalcohol $C_{13}$-6.0 | 23 Oxoalcohol $C_{13}$-6.5 | 24 Oxoalcohol $C_{13}$-7.0 | 25 Oxoalcohol $C_{13}$-4.5/7.0 |
|---|---|---|---|---|---|
| Standing Time (days) | 3/3 | 3/3 | 3/3 | 3/3 | 3/3 |
| Temperature (°C.) | 22/45 | 22/45 | 22/45 | 22/45 | 22/45 |
| Clear Phase (mm) | —/— | 2/3 | 5/5 | 5/5 | 1/1 |
| Homogeneity | 2/2 | 5/5 | 5/5 | 5/5 | 5/2 |
| Flowability | 4/4 | 5/5 | 5/5 | 5/5 | 5/2 |
| Bottom Sediment (mm) | —/— | —/— | —/— | —/— | —/— |
| Remark | Viscous | Viscous | Viscous | Viscous | Viscous |

Homogeneity and flowability are rated on scale of 1 to 5, 1 very good, 5 defective.

TABLE VII

STABILIZATION OF WESSALITH S. WITH OXO-ALCOHOL ETHOXYLATES

| | 26 Oxoalcohol $C_{13}$-5.0/7.0 | 27 Oxoalcohol $C_{13}$-4.5/6.0 | 28 Oxoalcohol $C_{13}$-4.5/6.5 | 29 Oxoalcohol $C_{13}$-5.0/6.5 | 30 Oxoalcohol $C_{13}$-5.0/7.0 |
|---|---|---|---|---|---|
| Standing Time (days) | 3/3 | 3/3 | 3/3 | 3/3 | 3/3 |
| Temperature (°C.) | 22/45 | 22/45 | 22/45 | 22/45 | 22/45 |
| Clear Phase (mm) | —/— | —/1 | —/— | —/— | 3/— |
| Homogeneity | 3/3 | 2/2 | 2/2 | 4/3 | 5/5 |
| Flowability | 4/4 | 4/2 | 4/4 | 4/4 | 5/5 |
| Bottom Sediment (mm) | —/— | —/— | —/— | —/— | —/— |
| Remark | Viscous | Viscous | Viscous | Viscous | Viscous |

Homogeneity and flowability are rated on scale of 1 to 5, 1 very good, 5 defective.

TABLE VIII

STABILIZATION OF WESSALITH S. WITH OXO-ALCOHOL ETHOXYLATES

| | 31 Oxoalcohol $C_{13}$-5.5/6.5 | 32 Oxoalcohol $C_{13}$-5.5/7.0 | 33 Oxoalcohol $C_{13}$-6.0/7.0 |
|---|---|---|---|
| Standing Time (days) | 3/3 | 3/3 | 3/3 |
| Temperature (°C.) | 22/45 | 22/45 | 22/45 |
| Clear Phase (mm) | 3/5 | 3/2 | 5/3 |
| Homogeneity | 5/5 | 5/5 | 5/5 |
| Flowability | 5/5 | 5/5 | 5/5 |
| Bottom Sediment (mm) | —/— | —/— | —/— |
| Remark | — | — | — |

Homogeneity and flowability are rated on scale of 1 to 5. 1 very good. 5 defective.

We claim:

1. A stable, aqueous, pumpable suspension of water-insoluble silicate capable of binding calcium ions comprising, based on the total weight of the aqueous suspension:

(A) 0.5 to 80% by weight of a finely divided water-insoluble aluminum silicate compound containing bound water and capable of binding calcium, represented by the formula:

$$(Cat_{2/n}O)_x \cdot Me_2O_3 \cdot (SiO_2)_y.$$

wherein Cat is an n-valent cation exchangeable with calcium, n is a number from 0.7 to 1.5, Me is aluminum, and y is a number from 0.8 to 6, and (B) 0.5 to 6% by weight of a mixture acting as a dispersing ingredient, said mixture containing at least four oxoalcohol ethoxylates of formula (II)

$$R—(OCH_2CH_2)_n—OH \quad (II).$$

wherein the first oxo-alcohol ethoxylate has R equal to a first alkyl chain length containing from 10 to 15 carbon atoms with a branching rate of at most 25%, wherein a maximum of 25% of the fatty alcohol ethoxylate includes a single methyl branching, and n is from 3–5;

the second oxo-alcohol ethoxylate has R equal to said first alkyl chain length, said second oxo-alcohol ethoxylate likewise with a branching rate of at most 25%, wherein a maximum of 25% of the fatty alcohol ethoxylate includes a single methyl branching, and n is from 5.5–7;

the third oxo-alcohol ethoxylate has R equal to a second alkyl chain length differing from said first alkyl chain length by at least one carbon atom, said third oxo-alcohol ethoxylate including said second alkyl chain length likewise contains 10–15 carbon atoms with a branching rate of at most 25%, wherein a maximum of 25% of the fatty alcohol ethoxylate includes a single methyl branching, and n is from 3–5;

the fourth oxo-alcohol ethoxylate has R equal to said second alkyl chain length, said fourth oxo-alcohol ethoxylate including said second alkyl chain length likewise with a branching rate of at most 25%, wherein a maximum of 25% of the fatty alcohol ethoxylate includes a single methyl branching, and n is from 5.5–7; wherein the ratio of the first and third oxo-alcohol ethoxylate components to the second and fourth oxo-alcohol ethoxylate components is from 9:1 to 1:9, wherein the first alkyl chain length and the second alkyl chain length are each present in sufficient amounts so as to improve the stability and the pumpable consistency of the suspensions in a temperature range of about 10° to 50° C.

2. The suspension as defined in claim 1, wherein component (A) is crystalline.

3. The suspension as defined in claim 1, wherein in the formula of component A, y denotes a number from 1.3 to 4.

4. The suspension as defined in claim 1, wherein component A is a zeolite A.

5. The suspension as defined in claim 1, wherein the first and third oxo-alcohol ethoxylate components have a turbidity point of 56° to 69° C., and the second and fourth oxo-alcohol ethoxylate components have a turbidity point of 70° to 80° C.

6. The suspension as defined in claim 5, wherein said first and third ethoxylate components contain 4–5 moles of ethylene oxide and a turbidity point of 62°–67° C., and the first alkyl chain length contains 12 carbons and the second alkyl chain length contains 13 carbons.

7. The suspension as defined in claim 5, wherein said second and fourth ethoxylate components contain 5.5–6.5 moles of ethylene oxide and a turbidity point of 71°–79° C., and the first and second alkyl chain lengths contain from 12 to 15 carbons.

8. The suspension as defined in claim 1, wherein the calcium binding capability of the aluminum silicate is 100 to 200 mg CaO per gram of anhydrous aluminum silicate.

9. The suspension as defined in claim 1, wherein the aluminum silicate is represented by the formula:

$$0.7-1.1\ Na_2O.Al_2O_3.\ 1.3-3.3\ SiO_2$$

10. The suspension as defined in claim 1, wherein the concentration of component (B) is 1 to 2% by weight.

11. The suspension as defined in claim 1, wherein the suspension has a solid content of at least 50%.

12. The suspension as defined in claim 1, which after standing for 72 hours, the height of supernatant clear solution free of silicate particles is no more than 20% of the total height.

13. The suspension as defined in claim 1, which after standing for 72 hours, the height of supernatant clear solution free of silicate particles is no more than 10% of the total height.

14. The suspension as defined in claim 1, wherein the particle size of the aluminum silicate is from 5 to 30 microns.

15. A detergent composition containing a sufficient amount of the product obtained from the suspension of claim 1.

16. The method of preparing a free-flowing detergent or cleaning composition comprising mixing at least one detergent or cleaning compound with the suspension of claim 1 and spray drying the resulting mixture to obtain the desired product.

17. The detergent or cleaning composition obtained by the method of claim 16.

18. The suspension as defined in claim 1, wherein said first alkyl chain length contains 12 carbons, wherein said first oxo-alcohol ethoxylate contains 4.5 moles ethylene oxide, and said second oxo-alcohol ethoxylate contains 5.5 moles ethylene oxide; and said second alkyl chain length contains 13 carbon atoms, wherein said third oxo-alcohol ethoxylate contains 4.5 moles ethylene oxide, and said fourth oxo-alcohol ethoxylate contains 5.5 moles ethylene oxide.

19. The suspension as defined in claim 1, wherein said first alkyl chain length contains 12 carbons, wherein said first oxo-alcohol ethoxylate contains 4.5 moles ethylene oxide, and said second oxo-alcohol ethoxylate contains 6.0 moles ethylene oxide; and said second alkyl chain length contains 13 carbon atoms, wherein said third oxo-alcohol ethoxylate contains 4.5 moles ethylene oxide, and said fourth oxo-alcohol ethoxylate contains 6.0 moles ethylene oxide.

20. The suspension as defined in claim 1, wherein said first alkyl chain length contains 12 carbons, wherein said first oxo-alcohol ethoxylate contains 4.75 moles ethylene oxide, and said second oxo-alcohol ethoxylate contains 6.0 moles ethylene oxide; and said second alkyl chain length contains 13 carbon atoms, wherein said third oxo-alcohol ethoxylate contains 4.75 moles ethylene oxide, and said fourth oxo-alcohol ethoxylate contains 6.0 moles ethylene oxide.

21. The suspension as defined in claim 1, wherein said first alkyl chain length contains 12 carbons, wherein said first oxo-alcohol ethoxylate contains 4.0 moles ethylene oxide, and said second oxo-alcohol ethoxylate contains 6.5 moles ethylene oxide; and said second alkyl chain length contains 13 carbon atoms, wherein said third oxo-alcohol ethoxylate contains 4.0 moles ethylene oxide, and said fourth oxo-alcohol ethoxylate contains 6.5 moles ethylene oxide.

22. The suspension as defined in claim 1, wherein said first alkyl chain length contains 14 carbons, wherein said first oxo-alcohol ethoxylate contains 5.0 moles ethylene oxide, and said second oxo-alcohol ethoxylate contains 7.0 moles ethylene oxide; and said second alkyl chain length contains 15 carbon atoms, wherein said third oxo-alcohol ethoxylate contains 5.0 moles ethylene oxide, and said fourth oxo-alcohol ethoxylate contains 7.0 moles ethylene oxide.

23. The suspension as defined in claim 1, wherein said first alkyl chain length contains 12 carbons, wherein said first oxo-alcohol ethoxylate contains 4.5 moles ethylene oxide, and said second oxo-alcohol ethoxylate contains 7.0 moles ethylene oxide; and said second alkyl chain length contains 13 carbon atoms, wherein said third oxo-alcohol ethoxylate contains 4.5 moles ethylene oxide, and said fourth oxo-alcohol ethoxylate contains 7.0 moles ethylene oxide.

24. A stable, aqueous, pumpable suspension of water-insoluble silicate capable of binding calcium ions comprising, based on the total weight of the aqueous suspension:

(A) 0.5 to 80% by weight of a finely divided water-insoluble aluminum silicate compound containing bound water and capable of binding calcium, represented by the formula:

$$(Cat_{2/n}O)_x \cdot Me_2O_3 \cdot (SiO_2)_y,$$

where Cat is an n-valent cation exchangeable with calcium, n is a number from 0.7 to 1.5, Me is aluminum and y is a number from 0.8 to 6, and (B) 0.5 to 6% by weight of a mixture acting as a dispersing ingredient, said mixture containing four oxo-alcohol ethoxylates of formula (II)

$$R-(OCH_2CH_2)_n-OH \quad (II),$$

wherein the first oxo-alcohol ethoxylate has R = 12 carbons and n = 5 moles of ethylene oxide;

the second oxo-alcohol ethoxylate has R = 13 carbons and n = 5 moles of ethylene oxide;

the third oxo-alcohol ethoxylate has R = 14 carbons and n = 7 moles of ethylene oxide; and the fourth oxo-alcohol ethoxylate has R = 15 carbons and n = 7 moles of ethylene oxide, wherein each of the R groups identified above are present in a sufficient amount so as to improve the stability and the pumpable consistency of the suspension in a temperature range of about 10° to 50° C.

25. A stable, aqueous, pumpable suspension of water-insoluble silicate capable of binding calcium ions comprising, based on the total weight of the aqueous suspension:

(A) 0.5 to 80% by weight of a finely divided water-insoluble aluminum silicate compound containing bound water and capable of binding calcium, represented by the formula:

$$(Cat_{2/n}O)_x \cdot Me_2O_3 \cdot (SiO_2)_y,$$

where Cat is an n-valent cation exchangeable with calcium, n is a number from 0.7 to 1.5, Me is aluminum and y is a number from 0.8 to 6, and (B) 0.5 to 6% by weight of a mixture acting as a dispersing ingredient, said mixture containing six oxo-alcohol ethoxylates of formula (II)

$$R-(OCH_2CH_2)_n-OH \quad (II),$$

wherein the first oxo-alcohol ethoxylate has R = 12 carbons and n = 5 moles of ethylene oxide;

the second oxo-alcohol ethoxylate has R = 13 carbons and n = 5 moles of ethylene oxide;

the third oxo-alcohol ethoxylate has R = 14 carbons and n = 5 moles of ethylene oxide;

the fourth oxo-alcohol ethoxylate has R = 15 carbons and n = 5 moles of ethylene oxide;

the fifth oxo-alcohol ethoxylate has R = 14 carbons and n = 7 moles of ethylene oxide; and the sixth oxo-alcohol ethoxylate has R = 15 carbons and n = 7 moles of ethylene oxide, wherein each of the R groups identified above are present amounts sufficient so as to improve the stability and the pumpable consistency of the suspension in a temperature range of about 10° to 50° C.

26. A stable, aqueous, pumpable suspension of water-insoluble silicate capable of binding calcium ions comprising, based on the total weight of the aqueous suspension:

(A) 0.5 to 80% by weight of a finely divided water-insoluble aluminum silicate compound containing bound water and capable of binding calcium, represented by the formula:

$$(Cat_{2/n}O)_x \cdot Me_2O_3 \cdot (SiO_2)_y,$$

where Cat is an n-valent cation exchangeable with calcium, n is a number from 0.7 to 1.5, Me is aluminum and y is a number from 0.8 to 6, and (B) 0.5 to 6% by weight of a mixture acting as a dispersing ingredient, said mixture containing six oxo-alcohol ethoxylates of formula (II)

$$R-(OCH_2CH_2)_n-OH \quad (II),$$

wherein the first oxo-alcohol ethoxylate has R=12 carbons and n=5 moles of ethylene oxide;

the second oxo-alcohol ethoxylate has R=13 carbons and n=5 moles of ethylene oxide;

the third oxo-alcohol ethoxylate has R=14 carbons and n=5 moles of ethylene oxide;

the fourth oxo-alcohol ethoxylate has R=15 carbons and n=5 moles of ethylene oxide;

the fifth oxo-alcohol ethoxylate has R=12 carbons and n=6.5 moles of ethylene oxide; and the sixth oxo-alcohol ethoxylate has R=13 carbons and n=6.5 moles of ethylene oxide, wherein each of the R groups identified above are present amounts sufficient so as to improve the stability and the pumpable consistency of the suspension in a temperature range of about 10° to 50° C.

27. A stable, aqueous, pumpable suspension of water-insoluble silicate capable of binding calcium ions comprising, based on the total weight of the aqueous suspension:

(A) 0.5 to 80% by weight of a finely divided water-insoluble aluminum silicate compound containing bound water and capable of binding calcium, represented by the formula:

$$(Cat_{2/n}O)_x \cdot Me_2O_3 \cdot (SiO_2)_y,$$

where Cat is an n-valent cation exchangeable with calcium, n is a number from 0.7 to 1.5, Me is aluminum and y is a number from 0.8 to 6, and (B) 0.5 to 6% by weight of a mixture acting as a dispersing ingredient, said mixture containing four oxo-alcohol ethoxylates of formula (II)

$$R-(OCH_2CH_2)_n-OH \qquad (II)$$

wherein the first oxo-alcohol ethoxylate has R=12 carbons and n=3 to 5 moles of ethylene oxide;

the second oxo-alcohol ethoxylate has R=13 carbons and n=3 to 5 moles of ethylene oxide;

the third oxo-alcohol ethoxylate has R=12 carbons and n=5.5 to 7 moles of ethylene oxide; and the fourth oxo-alcohol ethoxylate has R=13 carbons and n=5.5 to 5 moles of ethylene oxide, wherein the overall ratio of ethoxylates with n=3 to 5 moles ethylene oxide with ethoxylates with n=5.5 to 7 moles ethylene oxide is about 1:1 ratio, wherein the suspension maintains a pumpable consistency in a temperature range of about 10° to 50° C.

* * * * *